US011051552B2

(12) United States Patent
Mironov et al.

(10) Patent No.: US 11,051,552 B2
(45) Date of Patent: Jul. 6, 2021

(54) AEROSOL-GENERATING SYSTEMS AND METHODS FOR GUIDING AN AIRFLOW INSIDE AN ELECTRICALLY HEATED AEROSOL-GENERATING SYSTEM

(71) Applicant: Philip Morris Products S.A., Neuchatel (CH)

(72) Inventors: Oleg Mironov, Neuchatel (CH); Ihar Nikolaevich Zinovik, Peseux (CH); Keethan Dasnavis Fernando, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/877,210

(22) Filed: May 18, 2020

(65) Prior Publication Data

US 2020/0275702 A1 Sep. 3, 2020

Related U.S. Application Data

(63) Continuation of application No. 15/536,399, filed as application No. PCT/EP2015/079623 on Dec. 14, 2015, now Pat. No. 10,750,784.

(30) Foreign Application Priority Data

Dec. 15, 2014 (EP) ..... 14197849
Jul. 13, 2015 (EP) ..... 15176545

(51) Int. Cl.
*A24F 13/00* (2006.01)
*A24F 17/00* (2006.01)
(Continued)

(52) U.S. Cl.
CPC ..... *A24F 40/46* (2020.01); *A24F 40/48* (2020.01); *A24F 40/485* (2020.01); *F22B 1/284* (2013.01); *A24F 40/10* (2020.01)

(58) Field of Classification Search
CPC ..... A24F 40/46; A24F 40/44; A24F 27/008
(Continued)

(56) References Cited

U.S. PATENT DOCUMENTS 9,439,455 B2 * 9/2016 Alarcon ..... A24F 40/51
9,820,512 B2 * 11/2017 Mironov ..... A24F 40/42
(Continued)

FOREIGN PATENT DOCUMENTS

CN 103 783 674 A 5/2014
EP 1 699 071 A1 9/2006
(Continued)

OTHER PUBLICATIONS

International Search Report and Written Opinion dated Apr. 12, 2016 in PCT/EP2015/079623, filed Dec. 14, 2015.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

An aerosol-generating system is provided, including: a liquid storage portion including a container configured to hold a liquid aerosol-forming substrate and defining an opening at an end thereof; a heater assembly extending across the opening along a plane transverse to a longitudinal axis of the portion and including an arrangement of one or more electrically conductive flat filaments; a capillary material disposed between the portion and the heater assembly and being configured to convey the substrate to the one or more filaments; and conductive contacts, disposed in electrical contact with corresponding contacts of the heater assembly, the portion being disposed at a first side of the heater assembly and a first airflow channel being disposed at a second side of the heater assembly, and the first airflow
(Continued)

channel defining an airflow pathway that extends in a direction orthogonal to the plane and to a surface of the capillary material.

23 Claims, 4 Drawing Sheets

(51) Int. Cl.

| | |
|---|---|
| ***A24F 25/00*** | (2006.01) |
| ***A24F 40/46*** | (2020.01) |
| ***A24F 40/48*** | (2020.01) |
| ***A24F 40/485*** | (2020.01) |
| ***F22B 1/28*** | (2006.01) |
| *A24F 40/10* | (2020.01) |

(58) Field of Classification Search
USPC ..... 131/329
See application file for complete search history.

(56) References Cited

U.S. PATENT DOCUMENTS

| | | | | |
|---|---|---|---|---|
| 2008/0092912 | A1* | 4/2008 | Robinson | A24B 15/12 131/200 |
| 2009/0272379 | A1* | 11/2009 | Thorens | A24F 40/44 128/202.21 |
| 2011/0094523 | A1* | 4/2011 | Thorens | H05B 1/0244 131/194 |
| 2011/0265806 | A1 | 11/2011 | Alarcon et al. | |
| 2014/0182610 | A1* | 7/2014 | Liu | A24F 40/485 131/329 |
| 2014/0305454 | A1* | 10/2014 | Rinker | A24F 40/50 131/329 |
| 2014/0318559 | A1* | 10/2014 | Thorens | A24F 40/485 131/329 |
| 2015/0020832 | A1* | 1/2015 | Greim | A24F 40/40 131/329 |
| 2015/0327596 | A1* | 11/2015 | Alarcon | H04L 67/22 131/328 |
| 2017/0035113 | A1* | 2/2017 | Thorens | A24F 40/485 |
| 2018/0242639 | A1* | 8/2018 | Borkovec | A24F 40/44 |

FOREIGN PATENT DOCUMENTS

| | | | | |
|---|---|---|---|---|
| EP | 2 574 247 | A1 | 4/2013 | |
| EP | 2798968 | A4 * | 9/2015 | A61M 11/047 |
| EP | 2798968 | A4 | 9/2015 | |
| JP | 2011-103476 | A | 5/2011 | |
| JP | 2013-524835 | A | 6/2013 | |
| UA | a 2015 08996 | | 1/2016 | |
| WO | 2011/137453 | A2 | 11/2011 | |
| WO | 2013/083635 | A1 | 6/2013 | |
| WO | 2015/066127 | A1 | 5/2015 | |
| WO | 2015079197 | A1 | 6/2015 | |
| WO | WO-2015079197 | A1 * | 6/2015 | A61M 15/06 |
| WO | 2015/117700 | A1 | 8/2015 | |

OTHER PUBLICATIONS

Office Action dated Aug. 27, 2018 in Japanese Patent Application No. 2017-530651, citing documents AN-AQ therein, 19 pages (with English translation).

Office Action dated Mar. 16, 2018 in Canadian Patent Application No. 2,963,727.

Extended European Search Report dated Mar. 2, 2021 in corresponding European Patent Application No. 20208979.3.

Provisional Conclusion of Substantive Examination dated Feb. 21, 2020 in counterpart Ukrainian Patent Application No. a 2017 04838 (English translation) (4 pages).

* cited by examiner

AEROSOL-GENERATING SYSTEMS AND METHODS FOR GUIDING AN AIRFLOW INSIDE AN ELECTRICALLY HEATED AEROSOL-GENERATING SYSTEM

CROSS-REFERENCE TO RELATED APPLICATIONS

This application is a continuation of U.S. application Ser. No. 15/536,399, filed Jun. 15, 2017, which is a National Stage of PCT/EP2015/079623, filed Dec. 14, 2015, and claims the benefit of priority under 35 U.S.C. § 119 of European Application No. 14197849.4, filed Dec. 15, 2014 and European Application No. 15176545.0 filed Jul. 13, 2015. The entire contents of which are incorporated herein by reference.

TECHNICAL FIELD

The invention relates to electrically heated aerosol-generating systems, such as electrically heated smoking systems, and a method for guiding an airflow inside such systems.

DESCRIPTION OF THE RELATED ART

Some aerosol-generating systems may comprise a battery and control electronics, a cartridge comprising a supply of aerosol forming substrate and an electrically operated vaporizer. A substance is vaporized from the aerosol forming substrate, for example by a heater. An airflow is made to pass the heater to entrain the vaporized liquid and guide it through a mouthpiece to a mouth end of the mouthpiece, while a user is inhaling (e.g. "puffing") at the mouth end.

It would be desirable to manage the flow air so that as much of the liquid vaporized by the heater as possible is carried away from the heating zone for inhalation during each puff. It would be further desirable to manage the flow so as to minimize the formation of droplets outside a desired inhalable range.

BRIEF DESCRIPTION OF THE DRAWINGS

Embodiments will now be further described, by way of example only, with reference to the accompanying drawings in which.

DETAILED DESCRIPTION

Figure 1:
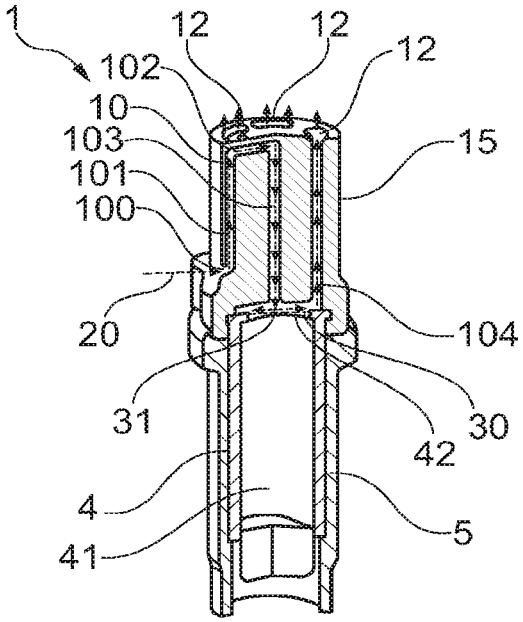
FIG. 1 shows an aerosol-generating system employing a flow of air according to embodiments consistent with the present disclosure.

According to a first aspect, there is provided an electrically heated smoking system for generating aerosol. The heated smoking system utilizes a heater positioned relative to an airflow system having a downstream end and one or more channels for drawing ambient air. Each of the one or more channels defines a respective flow route. A first flow route defined by a first channel directs air from outside the system so that it impinges against one or more electrical heating elements of the heater before conveying the ambient air to the downstream end. The air carried along each first flow route may be directed at the heater as ambient air without pre-heating, or it may be subjected to a pre-heating step before being brought into impingement against and along the heater.

In some embodiments, the air is brought by the first flow route into initial impingement along a path that is substantially orthogonal to a plane in which the electrical heating element(s) of the heater are arranged. Such an arrangement is advantageous because a perpendicular angle of impingement directed at the geometric center of a heater has been found to promote efficient entrainment of vapor. Where multiple channels are used, the respective flows may be combined prior to or somewhere along a common orthogonal path. Alternatively, the one or more flows may be brought into impingement with the heater assembly at any angle such that the flow impinges against and along a common plane which passes through the one or more heating element(s).

Vapor in the zone of the heater is collected by air flowing in the one or more channels and is transported to the downstream end of the airflow system. As the vapor condenses within the flowing air, droplets are formed to thereby generate an aerosol. It has been found that an ambient airflow impinging upon the heating element at 90 degree angle efficiently and effectively entrains the vapor so that it can be guided to a downstream "mouth" end of the system. The greater the ambient airflow striking the heating element, the greater the efficiency of entrainment and evacuation of vapor. In particular, if the ambient air impinges onto the surface of a heating assembly at an angle orthogonal to its geometric center, a homogeneous airflow over the heating element may be provided in a radially outward direction.

The volume of the ambient air passing through the first and any additional channels and brought into perpendicular impingement against the heating element(s) may be varied and adapted to, for example, the kind of heating element applied or the amount of vaporized liquid available. For example, the volume of ambient air brought into impingement with the heating element may be adapted to a total area, which is effectively heated by the heating element.

In embodiments, the heated, vapor-containing air leaving the zone of the heater is passed along a cooling zone in cross proximity to where the aerosol forming substrate is stored within the cartridge. Because the surface of the cartridge in this zone has a lower temperature than the vapor-containing air, such proximity has a substantial cooling effect. This effect is especially pronounced when the air is passed through thin channels dimensioned and arranged to maximize flow interaction within the surface of the cartridge. The rapid cooling which results causes an oversaturation of the air with the vaporized liquid which, in turn, promotes the formation of smaller aerosol droplets. In some embodiments, it is preferred to maintain the droplet size during vapor condensation to an inhalable range of from 0.5 to 1 microns.

In some embodiments, a sharp bend (e.g., on the order of 90 degree) in the flow of aerosol around the portion of the cartridge housing the liquid substrate performs a complementary droplet filtering function, wherein droplets in excess of the inhalable range condense in the corner(s) of the flow path such that they are not delivered to the downstream end.

As a general rule, whenever the term 'about' is used in connection with a particular value throughout this application this is to be understood such that the value following the term 'about' does not have to be exactly the particular value due to technical considerations. However, the term 'about' used in connection with a particular value is always to be understood to include and also to explicitly disclose the particular value following the term 'about'.

With respect to the orientation and position of the heater relative to an opening in a container containing an aerosol-generating liquid, the term "across" is intended to refer to an arrangement in which one or more heating elements through which a common plane passes (e.g., a plane transverse to the container opening") are positioned over or across at least part of the opening. In some embodiments, for example, the heater may completely cover the container opening while in other embodiments, the heater may only partially cover the container opening. In yet other embodiments, the heater may be positioned within the opening such that it extends across the entire opening on all sides, while in still others, the heater may be positioned such that it extends across a first pair of opposite side portions of the opening and not across a second pair of opposite side portions of the opening.

The terms 'upstream' and 'downstream' are used herein in view of the direction of an airflow in the system. Upstream and downstream ends of the system are defined with respect to the airflow when a user draws on the proximal or mouth end of the aerosol-generating smoking article. Air is drawn into the system at an upstream end, passes downstream through the system and exits the system at the proximal or downstream end. The terms 'proximal' and 'distal' as used herein refer to the position of an element with respect to its orientation to a consumer or away from a consumer. Thus, a proximal end of a mouthpiece of aerosol-generating system corresponds to the mouth end of the mouth piece. A distal opening of a cartridge housing corresponds to a position of an opening arranged in the cartridge housing facing away from a consumer, accordingly.

The heater used in smoking systems consistent with embodiments of the present disclosure may for example be a fluid permeable heating assembly comprising one or more electrically conductive heating elements. The one or more electrically conductive heating elements are dimensioned and arranged to generate heat when a current is applied to them. Fluid permeable heating assemblies are suitable for vaporizing liquids of different kind of cartridges. For example, as a liquid aerosol-forming substrate, a cartridge may contain a liquid or a liquid containing transport material such as for example a capillary material. Such a transport material and capillary material actively conveys liquid and is preferably oriented in the cartridge to convey liquid to the heating element. In embodiments, the one or more conductive heating elements are heat-producing filaments are arranged close to the liquid or to the liquid containing capillary material such that heat produced by a heating element vaporize the liquid. Preferably, the filaments and aerosol-forming substrate are arranged such that liquid may flow into interstices of the filament arrangement by capillary action. The filament arrangement may also be in physical contact with a capillary material.

In embodiments, a fluid permeable heating assembly comprises one or more heating elements through which a common plane passes, such that the heater has a substantially flat orientation. Such a heating element may for example be a flat coil embedded in a porous ceramic or a mesh heater, wherein a mesh or another filament arrangement is arranged over an opening in the heater. The fluid permeable heating assembly may, for example, comprise an electrically conductive mesh or coil pattern printed onto a heat resistance support piece. The support piece may for example be ceramic, polyether ether ketone (PEEK), or other thermally resistant ceramics and polymers that do not thermally decompose and release volatile elements at temperatures below 200 C and preferably at temperatures below 150 C.

The heater vaporizes liquid from a cartridge or cartridge housing comprising an aerosol-forming substrate. The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants.

The aerosol forming substrate may be conveyed to the heating element(s) via a capillary material in contact with or adjacent to the heating element(s). The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heating element. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid has physical properties, including but not limited to viscosity, surface tension, density, thermal conductivity, boiling point and vapour pressure, which allow the liquid to be transported through the capillary device by capillary action.

The capillary material may be in contact with electrically conductive filaments of the heater. The capillary material may extend into interstices between the filaments. The heating element may draw liquid aerosol-forming substrate into the interstices by capillary action. The capillary material may be in contact with the electrically conductive filaments over substantially the entire extent of an aperture in the heating element.

The heating element(s) may be provided in a heating assembly including support elements. The heating assembly may contain two or more different capillary materials, wherein a first capillary material, in contact with the heating element, has a higher thermal decomposition temperature and a second capillary material, in contact with the first capillary material but not in contact with the heating element has a lower thermal decomposition temperature. The first capillary material effectively acts as a spacer separating the heating element from the second capillary material so that the second capillary material is not exposed to temperatures above its thermal decomposition temperature. As used herein, 'thermal decomposition temperature' means the temperature at which a material begins to decompose and lose mass by generation of gaseous by products. The second capillary material may advantageously occupy a greater volume than the first capillary material and may hold more aerosol-forming substrate that the first capillary material. The second capillary material may have superior wicking performance to the first capillary material. The second capillary material may be a less expensive or have a higher filling capability than the first capillary material. The second capillary material may be polypropylene.

The flow route(s) may be selected to achieve a desired result, for example a predefined air volume passing through the one or more channels and impinging upon the heater surface(s). For example, a length or diameter of a channel may be varied, for example also to achieve a predefined resistance to draw (RTD). Flow route(s) are also selected according to a set-up of an aerosol generating smoking system and the arrangement and characteristics of the individual components of the smoking system. For example, aerosol may be generated at a proximal end or at a distal end of a cartridge housing containing the aerosol-forming substrate. Depending on the orientation of the cartridge in the aerosol-generating smoking system, the open end of the cartridge housing is arranged to face a mouthpiece or is arranged facing away from the mouthpiece. Accordingly, a heating element for heating the aerosol-forming substrate is arranged at a proximal or distal end of the housing. Preferably, liquid is vaporized at the open distal end of the mouthpiece and a heating element is arranged between cartridge and mouthpiece.

In some embodiments, one or more heating elements are arranged at an open proximal end of the cartridge housing, for example to cover the proximal end of the cartridge (top version). In such embodiments, the first flow route and first channel may be entirely arranged in a mouthpiece of the smoking system, a first air inlet is arranged in a side wall of the mouthpiece, and one or several outlets of the first channel are arranged in the proximal or mouth end of the mouthpiece. Optionally, additional flow routes and channels are defined in the mouthpiece. The first and any additional channels are arranged according to the location of the heating element(s) of the smoking system. In embodiments where for example, if a heating element is arranged at an open proximal end of the cartridge housing, for example to cover the proximal end of the cartridge (top version), the channel(s) may also be arranged entirely in a mouthpiece.

In alternative embodiments wherein the one or more heating elements are arranged at an open distal end of the cartridge housing, the flow route(s) routinely start at a further distal location in the smoking system, for example in the region of a distal end of the cartridge housing to this end, air inlet(s) and a first portion of each channel may be arranged in a main section of the smoking system to define a first channel portion in fluid communication with the corresponding channel portions defined in the mouthpiece. Ambient air is then directed into the system, passes the heating element at the distal end of the cartridge and entrains vapour generated by heating the aerosol-forming substrate in the cartridge. The aerosol containing air may then be guided along the cartridge between a cartridge housing and a main housing to the downstream end of the system, where it is mixed with ambient air from the first flow route (either before or upon reaching the downstream end).

A single channel may diverge into several channel portions downstream of the heating element(s), and several channel portions upstream of the heating element(s) may converge into a single channel before being brought into orthogonal impingement against a geometric center of the heater. In addition, a first channel may consist of several first partial channels and a second channel may consist of several second partial channels.

The flow routes may provide many variants to supply ambient air to the heating element and transport aerosol away from the heating element and to a downstream end of the system. For example, a radial supply of ambient air is preferably combined with and large central extraction. A central supply of ambient air is preferably combined with a radial distribution of the air over an entire heating element surface with a circumferential conveying of the aerosol containing air to the downstream end. In such embodiments, the flow routes are merged to direct ambient air to impinge onto the heating element, for example perpendicular to the heating element, preferably onto a center of the heating element.

Airflow directed perpendicularly to a center portion of heating element demonstrates improved aerosolization in terms of smaller particle sizes and higher amounts of total particulate matter present in the aerosol stream when compared to airflow that impinges the surface at an angle greater than 0 and less than 90 degrees. This may be due to a lower level of vortices created at the heater element and airflow interface, improved aerosol production by maximizing the whole of the heater (for example, portions outside of the center portion of the heater element contribute additional or higher amounts of aerosol), or due to a higher wicking effect based on a higher volume of air crossing the heating element.

A method for guiding an airflow in an electrically heated smoking system for generating aerosol comprises directing ambient air from outside the system perpendicularly against a heating element and conveying heated, vapor-containing air to promote supersaturation of vapor generated by heating of the liquid.

In FIG. 1, an embodiment for an aerosol generating smoking system is shown, comprising a cartridge 4 (also called a container 4) and a mouthpiece 1. An elongate main housing 5 accommodates the cartridge 4 having a tubular shaped container containing an aerosol-forming substrate 41, for example, a liquid containing capillary material. The container of the cartridge 4 has an open proximal end 42. A heater 30 is arranged to cover the open proximal end 42. In some embodiments, the heater 30 is a fluid permeable heater having a substantially flat profile. In an embodiment, the heater 30 is a substantially flat mesh arrangement of electrically heated filaments. The filaments or other heating element(s) of heater 30 may or may not be in direct physical contact with the aerosol-forming substrate 41. The mouthpiece 1, having a substantially tubular shaped elongate body 15, is aligned with the main housing 5, the cartridge 4, and the heater 30. The elongate body 15 has an open distal end facing the heater 30.

The embodiment shown in FIG. 1 comprises a first channel 10, which defines a first flow route in the mouthpiece 1. Incoming ambient air 20 enters the first flow route via inlet 100 and follows the flow path defined by first channel 10. This flow path brings the ambient air into impingement against the center of heater 30. Preferably, the impingement occurs at the geometric center of the heater and at angle at or close to ninety degrees (i.e., the flow is substantially orthogonal to a plane containing heated surface(s) of heater 30). The vaporized liquid produced by heater 30 is entrained as an aerosol by the air flow through the flow path, and from there the air is delivered to outlets 12 at a proximal end or at a mouth end of the mouthpiece 1, to be inhaled when a consumer puffs. In some embodiments, a single channel as first channel 10 may be alone sufficient for drawing a desired amount of ambient air with each puff. In other embodiments, it may be desirable to include two or more inlets and associated channels. For example, a second channel (not shown) may be provided to draw in additional air such that the ambient air flows are combined before impinging upon heater 30.

In the embodiment of FIG. 1, inlet 100 into the first flow route is an opening or bore hole in the mouthpiece 1 located at a distal half of the elongate body 15 of the mouthpiece 1. The first flow route in an upstream second channel portion 101 runs in the elongate body parallel to the circumference of the elongate body to the proximal end of the mouthpiece. In a radially inwardly directing portion 102 of the first channel 10, the first airflow 20 is directed to the center of the elongate body and, in a centrally arranged portion 103 of the first channel, the first airflow 20 is directed to the heater 30 to impinge to the center 31 of the heater 30. The first airflow 20 passes over the heater 30 and spreads radially outwardly to several longitudinal end portions 104 of the first channel 10. The longitudinal end portions 104 are regularly arranged along the circumference within the elongate body.

In this embodiment the flow route and corresponding channel is arranged entirely within the mouthpiece 1 of the aerosol generating system. One or more additional flow routes defined, for example, by symmetrically arranged channels, may be defined in the mouthpiece such that the flows merge by the time the ambient air reaches the centrally arranged portion 103.

Figure 2:
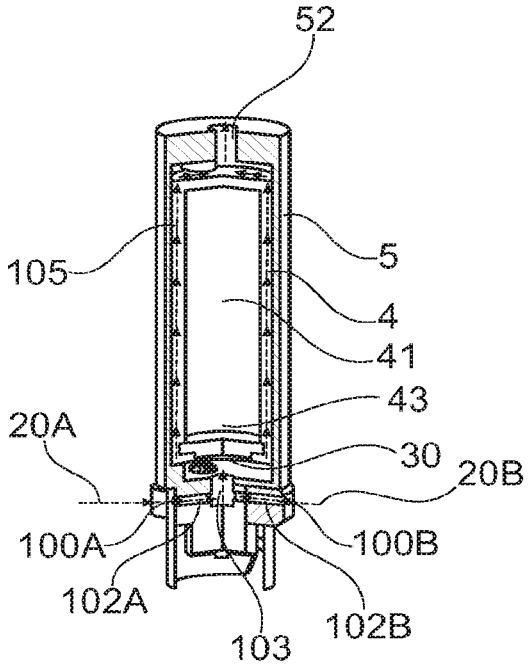
FIG. 2 shows an aerosol-generating system employing a flow of ambient air and vapor-entrained air according to other embodiments consistent with the present disclosure

In FIG. 2, an embodiment for an aerosol generating smoking system is shown, comprising a cartridge 4 with a heater 30 arranged at the bottom of the cartridge covering an open distal end 43 of a container containing an aerosol-forming substrate 41. In this embodiment, a first inlet 100A is arranged in the main housing 5 and ambient air 20A is directly led in a radially inwardly through portion 102A of the first channel 10 to the center of the main housing 5. In addition, a second inlet 100B is arranged in the main housing 5 and ambient air 20B is directly led in a radially inwardly through second channel 102B to the center of the main housing 5. The first and second channels merge to form a single flow within centrally arranged portion 103 of the first channel, and the merged air flow is directed to impinge perpendicularly onto the heater 30. The air flow then passes the heater 30, entrains aerosol caused by heating the aerosol-forming substrate 41 as it passes through the heater 30. The aerosol-containing air is led to the proximal end of the cartridge 4 after entering a ninety degree bend into one of several elongated, longitudinal portions 105 of first channel 10 arranged between and along cartridge 4 and an interior surface of main housing 5.

There, the aerosol containing airflow is guided to and out of a single centrally arranged opening 52 in the main housing 5. A mouthpiece (not shown) may be arranged adjacent to and aligned with the main housing. Preferably, the mouthpiece then also has a centrally arranged opening and end portion 104 of first channel 10 to receive the aerosol containing airflow and guide it to a single outlet opening 12 in the proximal end of the mouthpiece 1.

Figure 3A:
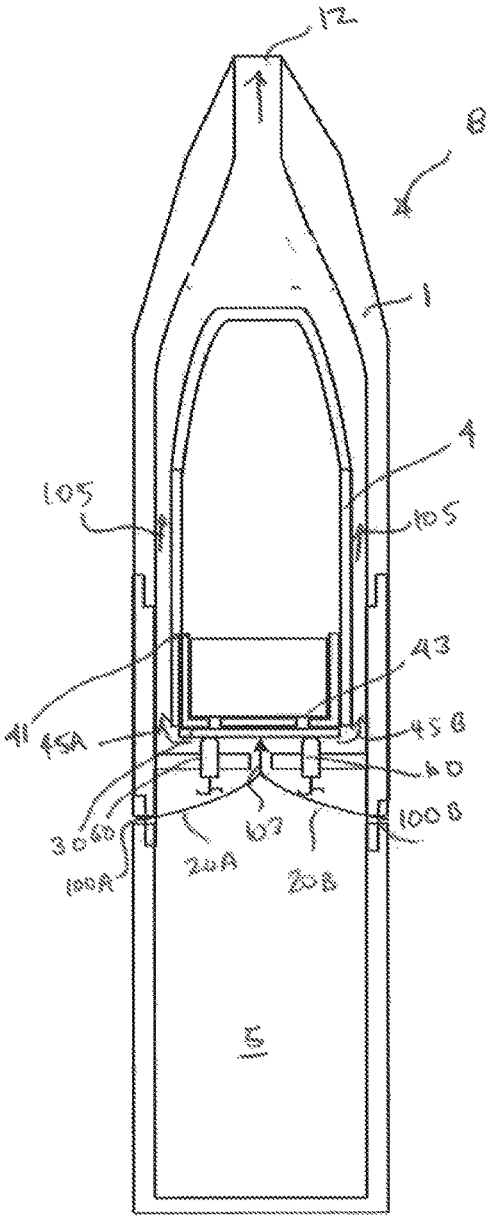
FIG. 3A shows the assembled form, in cross section, of an aerosol-generating system employing a flow of ambient air and vapor-entrained air according to another embodiment consistent with the present disclosure.
Figure 3B:
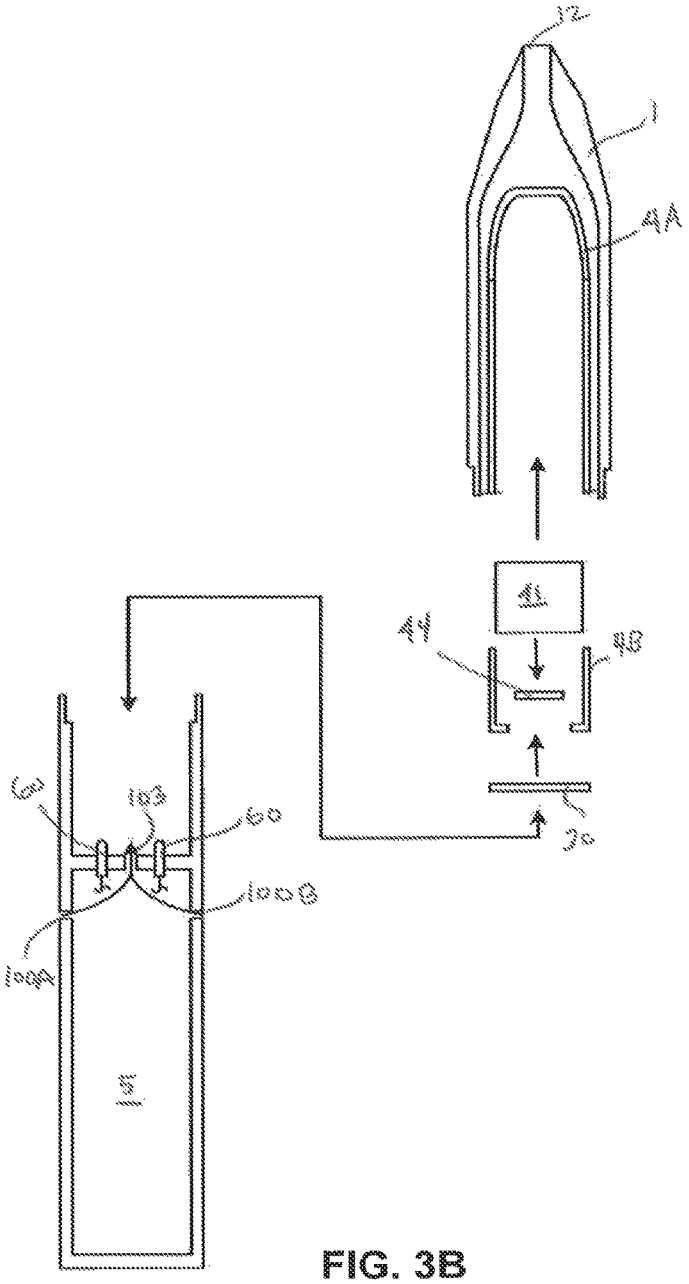
FIG. 3B shows a broken apart or unassembled form, in cross section, of the system depicted in the embodiment of FIG. 3A.

FIGS. 3A and 3B depict an additional embodiment of a system 8 that includes a cartridge 4 with heater 30 arranged at the bottom of the cartridge covering an open distal end 43 of the cartridge housing. In this embodiment, a first inlet 100A is arranged in the main housing 5 and ambient air 20A is directly led in a radially inwardly through portion 102A of the first channel 10 to the center of the main housing 5. In addition, a second inlet 100B is arranged in the main housing 5 and ambient air 20B is directly led in a radially inwardly through second channel 102B to the center of the main housing 5. The first and second channels merge to form a single flow within centrally arranged portion 103 of the first channel, and the merged air flow is directed to impinge perpendicularly onto the heater 30. Conductive contacts 60, which are electrically coupled to a power source (not shown) located within main housing 5 are in electrical contact with corresponding contacts of heater 30, and supply the heater with the electrical current.

The air arriving via first channel portion 103 passes the heater 30 and entrains vapor and condensed droplets caused by heating the liquid in the aerosol-forming substrate 41 through the heater 30. The aerosol so generated is led to the proximal end of the cartridge 4 after entering a ninety degree bend 45*a*, 45*b* into one of several elongate longitudinal portions 105 of first channel 10 arranged between and along cartridge 4. Thereafter, the aerosol guided to and out of a centrally arranged outlet opening 12 in the proximal end of the mouthpiece 1.

FIG. 3B is broken apart to show the system 8 in greater detail. It can be seen that the cartridge 4, comprising cartridge housing sections 4A and 4B, receives a liquid containing high retention material or high release material (HRM) as the aerosol-forming substrate 41, which serves as a liquid reservoir and to direct liquid towards the heater 30 for evaporation at the heater. A capillary disc 44, for example, a fiber disc, is arranged between HRM and heater 30. The material of the capillary disc 44 may be more heat resistant than the HRM due to its closeness to the heater 30 in order to provide thermal isolation and protect the HRM itself from de-composition. The capillary disc 44 is kept wet with the aerosol-forming liquid of the HRM to secure provision of liquid for vaporization if the heater is activated.

Figure 4:
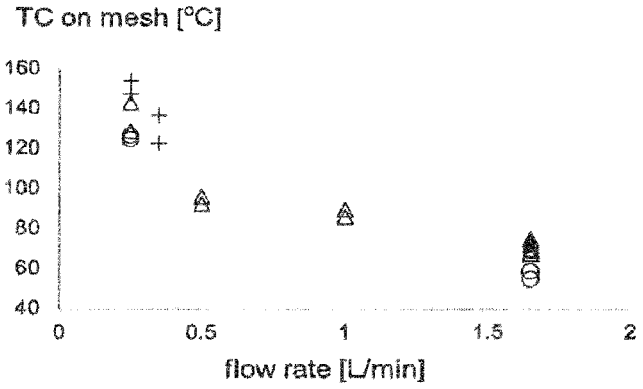
FIG. 4 shows the cooling effect of different airflows on different heating elements.

The data shown in FIG. 4 demonstrate the relationship between air flow rate and cooling of the mesh heater. Cooling rates were measured using different mesh heaters: Reking (45 micrometers/180 per inch), Haver (25 micrometers/200 per inch) and 3 strips Warrington (25 micrometers/250 per inch). Measurement data for the Reking heater are indicated by crosses, measurement data for the Haver heater are indicated by circles and measurement data for the 3 strips Warrington heater are indicated by triangles. All heaters were operated at three Watt. Temperature was measured with a thermocouple coupled to the heaters. Increasing the flow rate as indicated on the x-axis in liter per minute [L/min] results in a lower measured temperature on the mesh heater. Typical sizes of airflows in aerosol-generating systems can be approximated by standard smoking regimes, for example the Health Canada smoking regime, which leads to significant cooling of the heater. Exemplary smoking regimes such as Health Canada draw 55 ml of a mix of air and vapour over 2 seconds. An alternative regime is 55 ml over 3 seconds. Neither exemplary smoking regime mimics behaviour precisely but instead act as a proxy to what an average user would draw. To compensate for the higher cooling rate associated with a high rate of air flow and perpendicular impingement of air onto the surface(s) of heater 30, it may be necessary to supply increases levels of current to the heating element(s) thereof.

Figure 5:
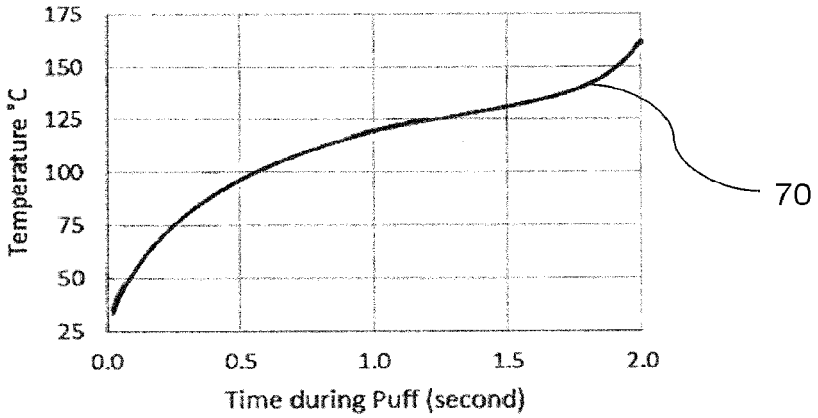
FIG. 5 shows a temperature curve based on an exemplary flow impingement pattern and substantially planar arrangement of powered heating filaments forming a mesh heater.

In the graph of FIG. 5, average temperatures at the heater versus time during one puff is shown. Curve 60 represents reference temperature data for the heater, where the total airflow is directed to the heater. For the reference data the heater had been heated with 5 Watt.

Figure 6:
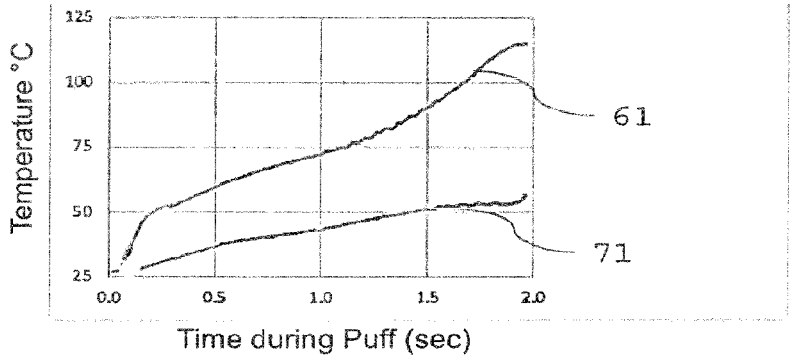
FIG. 6 shows temperature curves at an outlet of a mouthpiece.

FIG. 6 shows the effect, on the temperature of the aerosol carrying airflow at the outlet of the mouthpiece during one puff, of directing the vapor-entrained airflow along the portion of the cartridge 4 containing the aerosol-forming substrate 41. The data refers to embodiments where ambient airflow is brought in through outlets in a main housing, perpendicularly impinged against the surface of a substantially planar heater arranged in a transverse plane across a cartridge opening distal to the inhalation end of the mouthpiece, and bent around a downstream flow channel to carry the airflow toward the inhalation end of the mouthpiece, as shown in FIGS. 2 and 3A. Temperature curve 61 represents outlet air temperatures for a heater powered with 5 Watt with the total airflow impinging on the heater and exiting according to the arrangement shown in FIG. 1. Temperature curve 71 represents outlet air temperatures for a heater also powered with 5 Watts, but where the airflow is passed in close proximity to the liquid storage portion to promote cooling as shown in FIGS. 2 and 3A. There are significant lower temperatures of the aerosol carrying airflow at the proximal outlet of the main housing 5 and mouthpiece 1 in the arrangements of FIGS. 2 and 3A due to the transfer of heat to the zone of the cartridge housing proximate the liquid storage portion. Typically 'fresh' air mixed into the aerosol carrying airflow is at room temperature.

Figure 7:
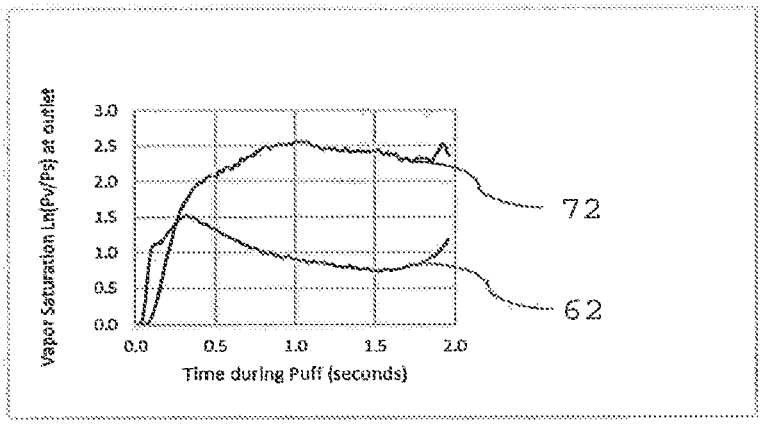
FIG. 7 shows average vapor saturation curves at an outlet of a mouthpiece.
Figure 8:
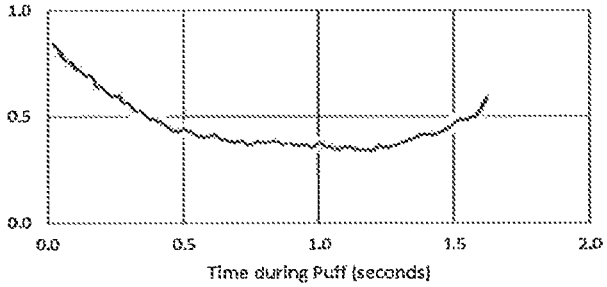
FIG. 8 shows a ratio of droplet diameters at an outlet of a mouthpiece for the air airflow geometries of FIGS. 1 and 2 for a same heater configuration and applied power.

Significant difference may also be seen in the ratio of vapour pressure to the saturation pressure (Pvapor/Psaturation) of a glycerol solution at the outlet of the mouthpiece during one puff. This ratio is shown in FIG. 7. Curve 72 refers to pressure data at the outlet for the heater powered with 5 Watt, with the total airflow directed to the heater according to the arrangements of FIGS. 2 and 3A. Curve 62 refers to pressure data at the outlet for the heater powered with 5 Watt with the total airflow impinging on the heater according to the arrangement of FIG. 1. This represents a larger degree of super saturation of the glycerol solution, which favours aerosolization with smaller droplets. Simulation clearly predicts smaller droplet sizes for the cooler vapour of the split airflow embodiment compared to vapour of non-split or total airflow embodiments. These simulation data 67 are shown in FIG. 8 for one puff at the outlet of the mouthpiece. Y-Axis represents the ratio of droplet diameters for split airflow to total airflow systems. The ratios are calculated and shown as d_split/d_ref=T*Ln(S) ref/T*Ln(S) split versus time (in seconds) during one puff on the aerosol-generating system where T is the temperature expressed in degrees Kelvin and S is the saturation ratio which is a function of Pv and P(T).

Figure 9A:
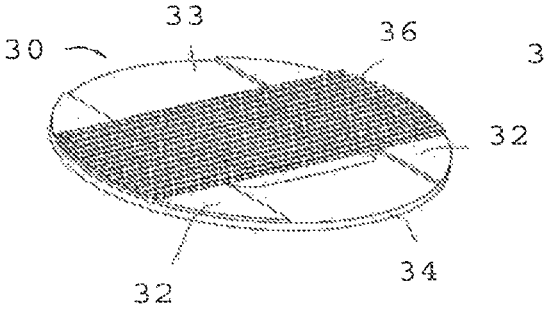
FIGS. 9A and 9B show heating elements according to embodiments consistent with the present disclosure.

FIG. 9*a* is an illustration of a first heater 30. The heater 30 is a fluid permeable assembly of heating elements and comprises a mesh 36 formed from 304L stainless steel, with a mesh size of about 400 Mesh US (about 400 filaments per inch). The filaments have a diameter of around 16 micrometer. The mesh is connected to electrical contacts 32 that are separated from each other by a gap 33 and are formed from a copper or tin foil having a thickness of around 30 micrometer. The electrical contacts 32 are provided on a polyimide substrate 34 having a thickness of about 120 micrometer. The filaments forming the mesh define interstices between the filaments. The interstices in this example have a width of around 37 micrometer, although larger or smaller interstices may be used. Using a mesh of these approximate dimensions allows a meniscus of aerosol-forming substrate to be formed in the interstices, and for the mesh of the heating element to draw aerosol-forming substrate by capillary action. The open area of the mesh, that is, the ratio of the area of interstices to the total area of the mesh is advantageously between 25 percent and 56 percent. The total resistance of the heating element is around 1 Ohm. The mesh provides the vast majority of this resistance so that the majority of the heat is produced by the mesh. In this example the mesh has an electrical resistance more than 100 times higher than the electrical contacts 32.

The substrate 34 is electrically insulating and, in this example, is formed from a polyimide sheet having a thickness of about 120 micrometer. The substrate is circular and has a diameter of 8 millimeter. The mesh is rectangular and has side lengths of 5 millimeter and 2 millimeter. These dimensions allow for a complete system having a size and shape similar to a convention cigarette or cigar to be made. Another example of dimensions that have been found to be effective is a circular substrate of diameter 5 millimeter and a rectangular mesh of 1 millimeter times 4 millimeter.

Figure 9B:
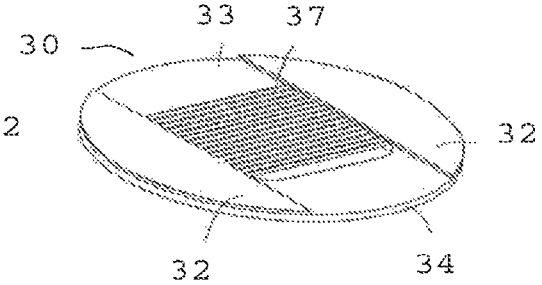

FIG. 9*b* is an illustration of an alternative heater assembly. In the heating element of FIG. 9*b*, the electrically conductive, heat-producing filaments 37 are bonded directly to substrate 34 and the contacts 32 are then bonded onto the filaments. The contacts 32 are separated from each other by insulating gap 33 as before, and are formed from copper foil of a thickness of around 30 micrometer. The same arrangement of substrate filaments and contacts can be used for a mesh type heater as shown in FIG. 8*a*. Having the contacts as an outermost layer can be beneficial for providing reliable electrical contact with a power supply.

Returning to FIGS. 1 to 3B, aerosol-forming substrate 41, such as a liquid containing capillary material, is advantageously oriented in the housing of cartridge 4 to convey liquid to the heater 30. When the cartridge 4 is assembled, the heater filaments 36 and 37 may be in contact with the capillary material and the aerosol-forming substrate 41 can be conveyed directly to the mesh heater.

In use the heating elements operate by resistive heating. Current is passed through the filaments 36 and 37 under the control of control electronics (not shown), to heat the filaments to within a desired temperature range. The mesh or array of filaments has a significantly higher electrical resistance than the electrical contacts 32,35 and electrical connectors (not shown) so that the high temperatures are localised to the filaments. The system may be configured to generate heat by providing electrical current to the heating element in response to a user puff or may be configured to generate heat continuously while the device is in an "on" state.

Different materials for the filaments may be suitable for different systems. For example, in a continuously heated system, graphite filaments are suitable as they have a relatively low specific heat capacity and are compatible with low current heating. In a puff actuated system, in which heat is generated in short bursts using high current pulses, stainless steel filaments, having a high specific heat capacity may be more suitable.

In the above cartridge systems as described in reference to FIG. 1 to FIG. 3B, the housing of cartridge 4 may also be a separate cartridge container in addition to the cartridge as described, for example, in reference to FIG. 1. Especially, a liquid containing cartridge is a pre-manufactured product, which may be inserted into a housing provided in the aerosol generating system for receiving the pre-manufactured cartridge.

The invention claimed is:

1. An aerosol-generating system, comprising:

a liquid storage portion comprising a container configured to hold a liquid aerosol-forming substrate and defining an opening at an end thereof;

a heater assembly extending across the opening along a plane transverse to a longitudinal axis of the liquid storage portion and comprising an arrangement of one or more electrically conductive flat filaments;

a capillary material disposed between the liquid storage portion and the heater assembly and being configured to convey the liquid aerosol-forming substrate to the one or more electrically conductive flat filaments; and conductive contacts, disposed in a main housing and making electrical contact with corresponding contacts of the heater assembly, wherein the liquid storage portion is disposed at a first side of the heater assembly, and a portion of a first airflow channel is disposed at a second side of the heater assembly, the portion of the first airflow channel extending in a direction orthogonal to the plane and being configured to direct air originating from outside the system in a direction towards a surface of the capillary material.

2. The aerosol-generating system according to claim 1, wherein the first airflow channel is directed at a geometric center of the heater assembly and across a surface portion thereof to provide a flow path over the one or more electrically conductive flat filaments.

3. The aerosol-generating system according to claim 2, wherein the flow path extends radially outward over the one or more electrically conductive flat filaments.

4. The aerosol-generating system according to claim 2, wherein the flow path extends from the heater assembly toward a mouth end of the system, the flow path having a sharp bend downstream of the heater assembly.

5. The aerosol-generating system according to claim 1, wherein the heater assembly has a substantially flat orientation, such that a common plane passes through the one or more electrically conductive flat filaments.

6. The aerosol-generating system according to claim 2, further comprising a second airflow channel defining another flow path through a portion of the system for air originating from outside the system, wherein the portion of the first airflow channel and said another flow path merge prior to or along a portion of the portion of the first airflow channel.

7. The aerosol-generating system according to claim 6, wherein the merged airflow is directed to impinge perpendicularly onto the one or more electrically conductive flat filaments.

8. The aerosol-generating system according to claim 1, wherein the first airflow channel diverges into plural channel portions downstream of the heater assembly.

9. The aerosol-generating system according to claim 1, wherein the first airflow channel includes plural first partial channels.

10. The aerosol-generating system according to claim 6, wherein the second airflow channel includes plural second partial channels.

11. The aerosol-generating system according to claim 1, further comprising a cartridge that is removably coupled to the main housing, wherein the liquid storage portion and the heater assembly are disposed in the cartridge and the main housing comprises a power supply.

12. The aerosol-generating system according to claim 11, wherein the conductive contacts are configured to be electrically coupled to the power supply.

13. The aerosol-generating system according to claim 11, wherein the main housing further comprises at least one air inlet configured to draw ambient air from outside the system, and at least a first portion of the first airflow channel corresponding to a flow path in fluid communication with the heater assembly.

14. The aerosol-generating system according to claim 11, wherein the main housing and the cartridge are configured to guide aerosol-containing airflow to and out of a single centrally arranged opening in the main housing.

15. The aerosol-generating system according to claim 11, wherein the cartridge further defines at least one of the air inlet configured to draw ambient air from outside the system, and at least a first portion of the first airflow channel corresponding to a flow path in fluid communication with the heater assembly.

16. The aerosol-generating system according to claim 1, wherein the capillary material is aligned with the opening and is further disposed in contact with the one or more electrically conductive flat filaments.

17. The aerosol-generating system according to claim 1, wherein the heater assembly partially covers the opening.

18. The aerosol-generating system according to claim 1, wherein the capillary material comprises a ceramic material.

19. The aerosol-generating system according to claim 1, wherein the capillary material is configured to remain wet with the liquid aerosol-forming substrate.

20. The aerosol-generating system according to claim 1, wherein the capillary material is in direct contact with the one or more electrically conductive flat filaments.

21. The aerosol-generating system according to claim 1, wherein the capillary material provides thermal isolation and protects the liquid aerosol-forming substrate in the liquid storage portion from decomposition.

22. The aerosol-generating system according to claim 1, further comprising a mouthpiece, wherein the opening faces away from the mouthpiece.

23. The aerosol-generating system according to claim 1, wherein the heater assembly is disposed at a distal end of the container.

* * * * *